US009676225B2

(12) United States Patent
Quiroz-Ziebart

(10) Patent No.: US 9,676,225 B2
(45) Date of Patent: Jun. 13, 2017

(54) MAGNETIZED WRITING AND AMUSEMENT DEVICE

(71) Applicant: Jose John Quiroz-Ziebart, Robbinsdale, MN (US)

(72) Inventor: Jose John Quiroz-Ziebart, Robbinsdale, MN (US)

( * ) Notice: Subject to any disclaimer, the term of this patent is extended or adjusted under 35 U.S.C. 154(b) by 0 days.

(21) Appl. No.: 14/702,155

(22) Filed: May 1, 2015

(65) Prior Publication Data

US 2015/0314633 A1 Nov. 5, 2015

Related U.S. Application Data

(60) Provisional application No. 61/987,496, filed on May 2, 2014.

(51) Int. Cl.

| | |
|---|---|
| ***B43K 29/00*** | (2006.01) |
| ***B43K 7/00*** | (2006.01) |
| ***B43K 19/00*** | (2006.01) |
| ***B43K 19/02*** | (2006.01) |
| ***B43K 21/00*** | (2006.01) |
| ***B43K 23/08*** | (2006.01) |
| ***A63H 33/04*** | (2006.01) |
| ***B43K 27/02*** | (2006.01) |
| ***B43L 19/00*** | (2006.01) |

(52) U.S. Cl.

CPC ..... *B43K 29/00* (2013.01); *A63H 33/046* (2013.01); *B43K 7/005* (2013.01); *B43K 19/003* (2013.01); *B43K 19/02* (2013.01); *B43K 21/006* (2013.01); *B43K 23/08* (2013.01); *B43K 27/02* (2013.01); *B43L 19/0062* (2013.01)

(58) Field of Classification Search

CPC ... B43L 19/0062; A63H 33/046; B43K 23/02; B43K 23/04; B43K 23/06; B43K 23/08; B43K 23/12; A45D 40/24

USPC ..... 401/195, 34, 35, 17, 19, 20, 21, 23; 446/146

See application file for complete search history.

(56) References Cited

U.S. PATENT DOCUMENTS

| | | | | |
|---|---|---|---|---|
| 5,044,804 A * | 9/1991 | Chuang | B43K 5/005 401/34 |
| 5,336,307 A * | 8/1994 | Horvat | C09D 13/00 106/31.94 |
| 5,338,123 A * | 8/1994 | Obersteller | B43K 23/12 401/17 |
| 6,746,167 B2 * | 6/2004 | Ahmed | B43K 8/003 401/35 |
| 7,780,499 B1 * | 8/2010 | Truckai | A63H 33/088 401/195 |
| 2009/0297250 A1 * | 12/2009 | Huang | B43K 5/005 401/243 |
| 2015/0023718 A1 * | 1/2015 | Gardner | B43K 8/003 401/195 |

FOREIGN PATENT DOCUMENTS

CH 668748 A * 1/1989

* cited by examiner

*Primary Examiner* — Jennifer C Chiang

(74) *Attorney, Agent, or Firm* — Greg N. Geiser; Gutwein Law

(57) ABSTRACT

A magnetized writing and amusement device. The device having a first end and a second end. Each of the ends having a magnet embedded with the interior. The magnetics allowing for the coupling of multiple devices together. The first end functions as a cap for the device and conceals a writing implement located within the internal structure of the device.

17 Claims, 3 Drawing Sheets

10

MAGNETIZED WRITING AND AMUSEMENT DEVICE

CROSS REFERENCE TO RELATED APPLICATIONS

This application claims priority to U.S. Provisional Patent Application No. 61/987,496 filed 2 May 2014 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

BACKGROUND OF THE INVENTION

Often throughout the course of learning or working an individual will have a tendency to lose focus during tedious tasks without having an implement in their hands to help them maintain focus. Often this device is a simple pen or pencil. However, it would be desirable to have an object that can both act as useful office tool, allow for a multitude of configurations, and be manipulated in a user's hands to help them not to fidget or become too restless. Preferably, this device can be easily configured and removably affixed to like devices and adaptable to any number of stackable configurations and uses.

SUMMARY OF THE INVENTION

A magnetized writing implement and amusement device embodying the principles of the present invention provides a user with a useful tool and desired distraction to provide an outlet for excess energy. By providing a user with an easily manipulated and configured object, the user is able to have an outlet for their distractive energy while at the same time maintaining focus for their desired task.

The device of the present invention provides a central portion for the receipt of several types of writing implements and office supplies. The device has at least two flat sides with the preferred shape being substantially rectangular with rounded off corners. The central portion acts as a receptacle for the internal components. At least one end cap is affixed to the central portion in a closed position. This end cap has a closed end and an open end. The open end designed for receipt around the central portion and the closed end including a magnet. In combination with the flat sides, the magnetic ends provide an attachment surface for the magnetic coupling of additional devices. This coupling allows a user to manipulate devices in combination for the creation of larger objects formed from coupled devices and additionally allows a user to twist, flip, and turn the devices in their hand to release distractive energy.

BRIEF DESCRIPTION OF THE SEVERAL VIEWS OF THE DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying photographs, and wherein.

DETAILED DESCRIPTION OF AN EMBODIMENT OF THE INVENTION

Figure 1:
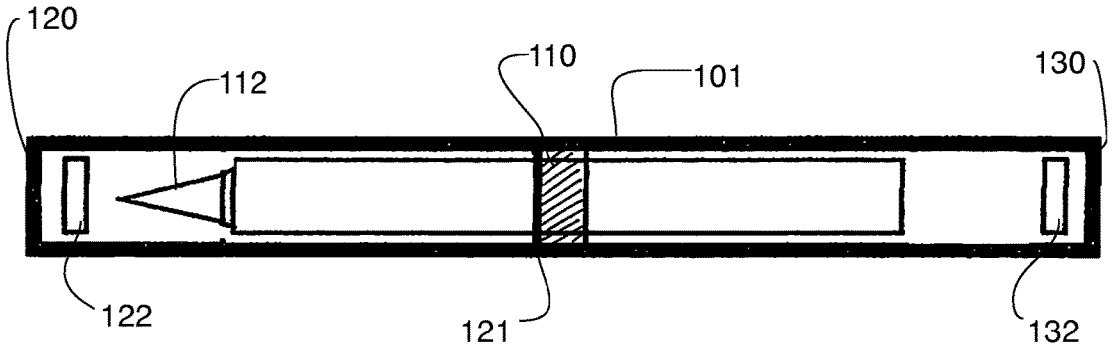
FIG. 1 is a side view of the magnetized writing implement and amusement device, according to the present invention.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-4, of the magnetized writing implement and amusement device, generally referred to as 10. The device 10 is generally adapted to contain a variety of writing implements and includes a first cap 102. The first cap 102 with a hollow interior substantially encapsulating a writing implement 112 of a central portion 101 when the first cap 102 is in an attached position. The first cap 102 having a first end 120 and a second end 121 opposite the first end 120. The first end 120 is closed and includes a magnet 122. The magnet 122 is placed and secured within the first end 120 so as to render the device 10 safe for use. The second end 121 is open to allow for the writing implement 112 of the central portion 101.

The device 10 central portion 101 is designed to house the writing implement 112. The writing implement 112 can be removably inserted within the central portion 101 and can be a pen, marker, mechanical pencil, pencil, highlighter, or other similar writing implement. The central portion 101 may include a metal surface 110 that is magnetic to allow for the coupling of magnets. The device 10 includes a second end 130 opposite the first end 120 of the first cap 102 and includes a magnet 132.

The magnets 122, 132 may be any number of magnetized implements, but it is preferred that the magnet 122, 132 is a single element of the rare earth type, although other similar now known or unknown magnetic articles may be used.

The device 10 is comprised of at least two flat sides with the preferred shape being substantially rectangular with rounded off corners.

Figure 2:
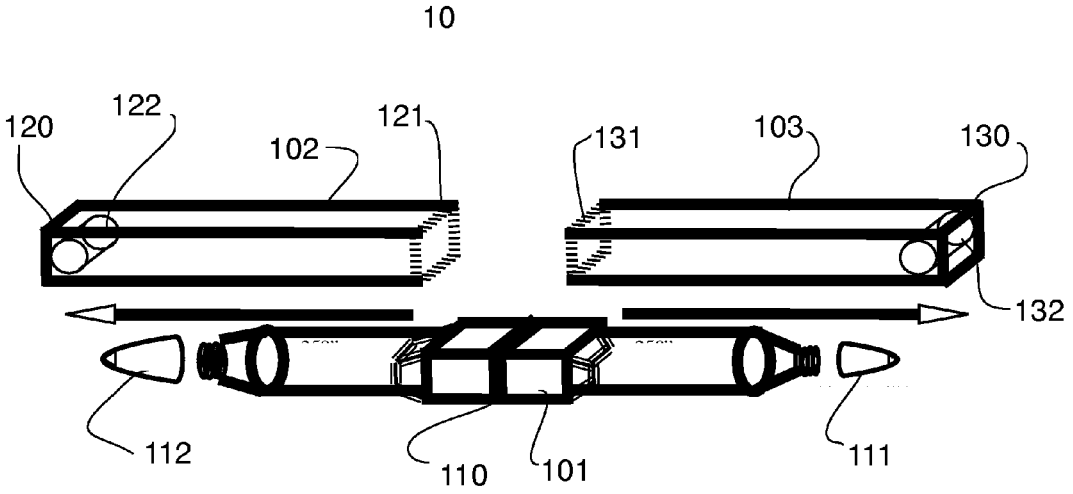
FIG. 2 is an exploded isometric view of an alternate embodiment of the magnetized writing implement and amusement device, according to the present invention.
Figure 3:
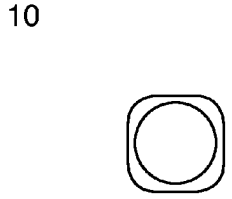
FIG. 3 is an end view of the magnetized writing implement and amusement device, according to the present invention.

In an alternate embodiment, as shown in FIG. 2, the device 10 may be configured with the central portion 101 including a pair of writing implements with the writing implement 112 and a second writing implement 111. The second writing implement 111 is configured to mirror the first writing implement 112 and extends from the central portion 101 opposite the first writing implement 112. The second writing implement 111 can be removably inserted within the central portion 101 and can be a pen, marker, mechanical pencil, pencil, highlighter, or other similar writing implement.

A second cap 103 designed to engage the central portion 101 with a hollow interior substantially encapsulating the second writing implement 103 of the central portion 101 when the second cap 103 is in an attached position. The second cap 103 having a first end 130 and a second end 131 opposite the first end 130. The first end 130 of the second cap 103 is closed and includes a magnet 132. The magnet 132 placed and secured with the first end 130 so as to render the device 10 safe for use. The magnet 132 may be any number of magnetized implements, but it is preferred that the magnet 132 is a single element of the rare earth type, although other similar now known or unknown magnetic articles may be used. The second end 131 is open to allow for the writing implement 111 of the central portion 101.

Although it is preferred that the central portion 101 receive a writing implement, it is logical that the central portion 101 may include other common devices that are readily known such as cosmetics, tape, erasers, lipsticks, eyeliners, or small tools.

Figure 4:
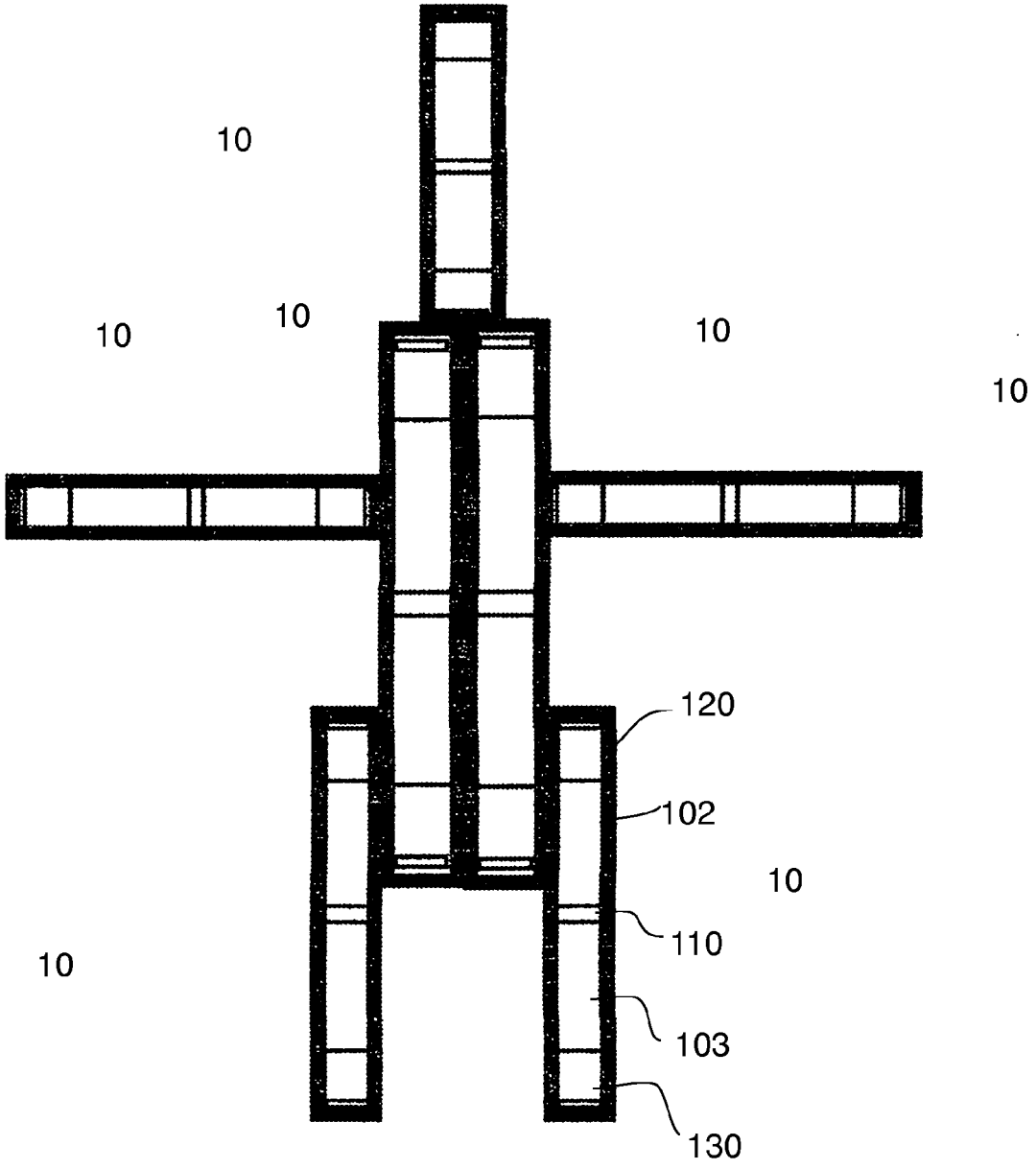
FIG. 4 is a side view of a structure assembled of several of the magnetized writing implement and amusement devices, according to the present invention.

Referring now specifically to FIG. 4, the multiple devices 10 are shown coupled together to form an artistic shape. As is shown, the magnets 122, 132 couple to adjoining devices and the metallic central portion 110. Accordingly, the devices 10 can be stacked and connected adjacently to build structures. Additionally, the devices 10 can be flipped, rolled, turned, and otherwise manipulated by a user in a tactilely desired fashion to create an outlet for distractive energy.

Preferably, the device 10 is provided in any number of shapes, sizes, lengths, and materials to aid in enjoyment and use.

In an alternate embodiment, the first cap 102 and the second cap 103 can be placed around an existing writing implement, wherein the first cap 102 and the second cap 103 secure to each other to contain the writing implement. According to this configuration, the first cap 102 and the second cap 103 act as a tubular receptacle for the existing writing implement with both the first cap 102 and the second cap 103 having the magnets 122, 132 at their opposed ends.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the specification.

What is claimed is:

1. A writing and amusement device, the device comprising:

a central portion, the central portion containing a writing implement;

a cap portion, the cap portion having a first end and second end, the first end having a magnet, the second end open and surrounding the writing implement in an attached position, wherein the cap portion is engaged with the central portion;

a second end, the second end opposite the first end of the cap portion when the cap portion is in the attached position, the second end having a magnet; and a metallic member, the metallic member positioned on the central portion at a middle position of the writing and amusement device.

2. A device as in claim 1, wherein the central portion and the cap portion have at least two flat sides.

3. A device as in claim 1, wherein the central portion and the cap portion have at least three flat sides.

4. A device as in claim 1, wherein the central portion and cap portion have at least four flat sides.

5. A device as in claim 1, wherein the writing implement is selected from the group of a pen, a pencil, a marker, a highlighter, a crayon, or a mechanical pencil.

6. A device as in claim 1, wherein the writing implement is removable.

7. A device as in claim 1, wherein the central portion and cap portion are rectangular in shape.

8. A writing and amusement device comprising:

a central portion, the central portion containing a first writing element and a second writing element, the first writing element and the second writing element extending opposite each other with each of the first writing element and the second writing element in communication with a metallic member positioned at a middle of the writing device;

a first cap portion, the first cap portion having a first end and second end, the first end having a magnet, the second end open and surrounding the first writing implement in an attached position; and a second cap portion, the second cap portion having a first end and second end, the first end having a magnet, the second end open and surrounding the second writing implement in an attached position.

9. A device as in claim 8, wherein the writing implement is selected from the group of a pen, a pencil, a marker, a highlighter, a crayon, or a mechanical pencil.

10. A device as in claim 8, wherein the writing implement is removable.

11. A device as in claim 8, wherein the central portion, first cap portion, and second cap portion have at least two flat sides.

12. A device as in claim 8, wherein the central portion, first cap portion, and second cap portion have at least three flat sides.

13. A device as in claim 8, wherein the central portion, first cap portion, and second cap portion have at least four flat sides.

14. A device as in claim 8, wherein the central portion, first cap portion, and second cap portion are rectangular in shape.

15. A writing and amusement device, the device comprising:

a central portion, the central portion containing a first writing implement, a second writing implement opposite the first writing element, and the central portion containing a metallic member, the central portion having an exterior, the exterior substantially flat and having at least four sides;

a first cap portion, the first cap portion having a first end and second end, the first end having a magnet, the second end open and surrounding the writing implement in an attached position, wherein the first cap portion is engaged with the central portion, the first cap portion having an exterior, the exterior substantially flat and having at least four sides; and a second cap portion, the second cap portion having a first end and a second end, the first end having a magnet, the second end open and surrounding the second writing implement in an attached position, the second cap portion having an exterior, the exterior substantially flat and having at least four sides.

16. A device as in claim 15, wherein the writing implement is selected from the group of a pen, a pencil, a marker, a highlighter, a crayon, or a mechanical pencil.

17. A device as in claim 15, wherein the writing implement is removable.

* * * * *